US006113308A

United States Patent [19]

Johnson, II

[11] Patent Number: 6,113,308

[45] Date of Patent: Sep. 5, 2000

[54] DEVICE FOR CUTTING FILLER MATERIAL FROM CONCRETE JOINTS

[76] Inventor: David R. Johnson, II, 2972 W. Sycamore Dr., Greenfield, Ind. 46140

[21] Appl. No.: 09/189,281

[22] Filed: Nov. 10, 1998

Related U.S. Application Data

[60] Provisional application No. 60/065,731, Nov. 14, 1997.

[51] Int. Cl.[7] ..... E01C 11/02

[52] U.S. Cl. ..... 404/74; 404/89; 37/903; 37/404; 172/253

[58] Field of Search ..... 404/74, 87, 89, 404/107, 128; 37/403, 407, 408, 380, 903, 220, 232, 404, 405, 406; 414/912; 172/247, 252, 253, 782

[56] References Cited

U.S. PATENT DOCUMENTS

| | | | |
|---|---|---|---|
| 2,185,052 | 12/1939 | Daugherty | 37/169 |
| 2,297,677 | 10/1942 | Forte | 414/912 |
| 2,541,309 | 2/1951 | Trail | 262/8 |
| 2,584,993 | 2/1952 | Eder | 262/8 |
| 2,722,064 | 11/1955 | Jaffe et al. | 37/232 |
| 2,838,856 | 6/1958 | Buisse | 37/404 |
| 2,864,184 | 12/1958 | Fohr | 37/142 |
| 3,043,200 | 7/1962 | Huttash | 94/22 |
| 3,347,597 | 10/1967 | Holifield | 299/36 |
| 3,791,696 | 2/1974 | Riley | 299/10 |
| 3,885,833 | 5/1975 | Lemieux | 299/36 |
| 4,096,652 | 6/1978 | Raines et al. | 37/232 |
| 4,171,849 | 10/1979 | Jacobson et al. | 299/36 |
| 4,189,854 | 2/1980 | Haynes | 414/912 |
| 4,201,000 | 5/1980 | Stanford | 414/912 |
| 4,560,011 | 12/1985 | Peterson et al. | 172/253 |
| 4,778,304 | 10/1988 | Baldi et al. | 404/87 |
| 4,867,602 | 9/1989 | Courtoise | 404/87 |
| 5,377,766 | 1/1995 | Klinger | 172/782 |
| 5,615,499 | 4/1997 | McGuire et al. | 37/367 |
| 5,819,445 | 10/1998 | LaBelle et al. | 414/912 |

*Primary Examiner*—Thomas B. Will
*Assistant Examiner*—Kristine Markovich
*Attorney, Agent, or Firm*—Ice Miller Donadio & Ryan; Jay G. Taylor; Russell E. Fowler, II

[57] ABSTRACT

A device for cutting filler material from concrete joints comprises a blate attached to the front of an elongated arm, the elongated arm is pivotably joined to a mounting plate. The elongated arm is limited in its movement by a retention bar located on a front edge of the mounting plate and a spring which biases the elongated arm toward the center of the mounting plate. An attachment lip is provided on the front edge of the mounting plate to assist in securing the mounting plate to a bucket of a power machine such as a front end loader. Bolts extending through the mounting plate and a rear turnbuckle also assist in securing the device to the bucket. Mounting is accomplished by placing the mounting plate in the bucket and hooking the lip around the front edge and under the bottom of the bucket. The rear turnbuckle includes a V-plate that engages the top rear of the bucket along the top rear edge. Elongation of the rear turnbuckle provides substantial pressure from the V-plate to the mounting plate and assists in securing the invention in the bucket. The bolts extending through the mounting plate may be tightened such that the bolts engage the surface of the bucket and further assist in securing the invention in the bucket. After mounting, the blade is placed in the side of an expansion joint, and movement of the power machine causes the blade to carve along the side of the expansion joint. Repeating this process along the opposite side of the joint sufficiently loosens or removes the filler material such that the filler material may be easily pulled from the joint.

19 Claims, 5 Drawing Sheets

DEVICE FOR CUTTING FILLER MATERIAL FROM CONCRETE JOINTS

CROSS-REFERENCES TO RELATED APPLICATIONS

This application claims the benefit of U.S. Provisional Application No. 60/065,731, filed Nov. 14, 1997.

FIELD OF THE INVENTION

The present invention relates to the field of cutting mechanisms, and in particular a cutting mechanism mounted to a front end loader for removing filler material from concrete joints.

BACKGROUND OF THE INVENTION

Concrete and other pavement used for paving roadways, aircraft landing strips, building floors, or similar surfaces will experience expansion and contraction as the result of changes in temperature. For this reason expansion joints are periodically located between concrete slabs during the paving process to provide room for expansion and contraction of the concrete slabs. Placement of expansion joints between concrete slabs greatly reduces cracking and buckling of the concrete when the concrete is exposed to extreme deviations of temperature.

Elastomeric sealants and filler materials are often used in concrete expansion joints to prevent water, dirt, and other elements from filling the expansion joints and causing damage to the concrete slabs. Additionally, filler material in the expansion joints provides a concrete surface void of deep grooves. Some of the sealants and filler materials typically used in the industry include rubberized asphalt, coal tar extended polysulfide, polyurethane polymers, rubberized polyvinyl chloride, silicone and the like. The flexible sealants and filler materials are somewhat elastic and may be compressed with expansion of the concrete slabs into the expansion joint and stretched with contraction of the concrete slabs from the expansion joint.

Filler material within an expansion joint will begin to wear and break down after a period of time. Wear of the filler material may be caused by a variety of factors including thermal expansion and contraction, exposure to the elements, spillage of fuel and other solvents upon the expansion joint, etc. Significant and substantial wear of the filler material will require that the filler material be removed from the expansion joint and replaced with new filler material in order for the filler material to perform its desired function of protecting the concrete slabs A primary method of removing filler material from concrete joints under the prior art is for a human worker to take a bladed knife or concrete saw to the expansion joint and carve the filler material from the joint. Of course, this method of removing filler material from the expansion joint is both time consuming and expensive in terms of man-hours. Therefore, some prior art inventions have developed mechanical devices that may be attached to tractors or similar industrial machines for carving filler material from expansion joints. Problems with these prior art devices exist because the devices been difficult to mount to a tractor or similar industrial machine, and have not been capable of universal mounting to various machines. Many prior art devices have required extensive changes to the machines carrying the device such as drilling holes or welding parts to the machine. Furthermore, prior art devices have included a large number of parts, making the devices expensive and complicated to build. Altogether, these prior art devices have been inefficient to use when considering mounting of the device to a tractor or similar machine, cost and difficulty of constructing the device, and overall ability of the device to remove filler material from concrete joints.

Accordingly, it is an object of the present invention to provide a device that may be quickly and easily assembled and mounted, and universally attached to tractors, front end loaders or similar industrial machines with buckets for carving filler material from expansion joints. It is another object of the invention to provide a device that may be mounted to a machine with little or no modification of the machine required. It is another object of the invention to provide a device for carving filler material from expansion joints that is relatively simple with few parts to be manufactured and assembled.

SUMMARY OF THE INVENTION

A device for removing filler material from concrete joints may be easily mounted to a bucket of a front end loader or similar power machine. The device comprises a mounting plate having a top, a bottom, a forward edge, and a rear edge. An elongated arm is pivotably attached to the top of the mounting plate near the rear edge. The elongated arm includes a free end extending past the forward edge of the mounting plate and a pivoting end pivotably attached near the rear edge of the mounting plate with a bolt and a nut. A blade is secured to the free end of the elongated arm. The blade is generally triangular, or trapezoidal, in shape and includes two cutting edges. The blade may be removed from the arm for sharpening or to switch the cutting edge.

A retention bar is positioned over the elongated arm to restrict excessive vertical movement of the elongated arm. The retention bar is connected to the mounting plate by a central connector located near the center of the retention bar, and two end connectors located near the ends of the retention bar. Two channels are defined by the retention bar, the central connector, the mounting plate and the end connectors. The elongated arm extends through one of the channels and movement of the elongated arm is restricted by the channel. A spring is attached to the elongated arm to provide a biasing force on the elongated arm. The biasing force encourages the arm toward the central connector. One end of the spring is linked to the mounting plate and the opposite end of the spring is centrally attached to the elongated arm. A coupler in the form of a first turnbuckle links the spring to the mounting plate. The first turnbuckle is capable of adjusting in length and thereby increasing or decreasing the spring tension and the associated biasing force acting upon the elongated arm.

An attachment lip for use in securing the device to the bucket of a front end loader extends along the forward edge of the mounting plate. The attachment lip hooks down from the top of the mounting plate and slightly back and under the mounting plate, thus defining a space for engaging a front edge of the bucket and assisting in mounting the device to the bucket. Skid plates are also connected to the forward edge of the mounting plate, and similar to the attachment lip, the skid plates hook down and under the front edge of the mounting plate. The skid plates are provided to protect the attachment lip during operation of the device, otherwise the attachment lip will drag along the pavement during operation.

Threaded bores are also formed in the mounting plate. The threaded bores extend through the mounting plate and are capable of receiving bolts which assist in mounting the device in the bucket. For further assistance in securing the device in the bucket, a second turnbuckle is provided to wedge the device in the bucket. The second turnbuckle is connected at one end to a hinge near the rear edge of the mounting plate. The opposite end of the turnbuckle is connected to a V-shaped plate. The V-shaped plate engages a back edge of the bucket and extension of the turnbuckle wedges the device between the back edge of the bucket and the bucket body.

Once the device is mounted, the blade is placed in the side of an expansion joint, and movement of the power machine causes the blade to carve along the side of the expansion joint. Repeating this process along the opposite side of the joint sufficiently loosens or removes the filler material such that the filler material may be easily pulled from the joint.

Accordingly, the present invention provides an improved device for cutting filler material from concrete joints. The device for cutting filler material from concrete joints may be easily manufactured and assembled, and universally mounted without complication to the bucket of a front end loader or the like.

DETAILED DESCRIPTION

Figure 1:
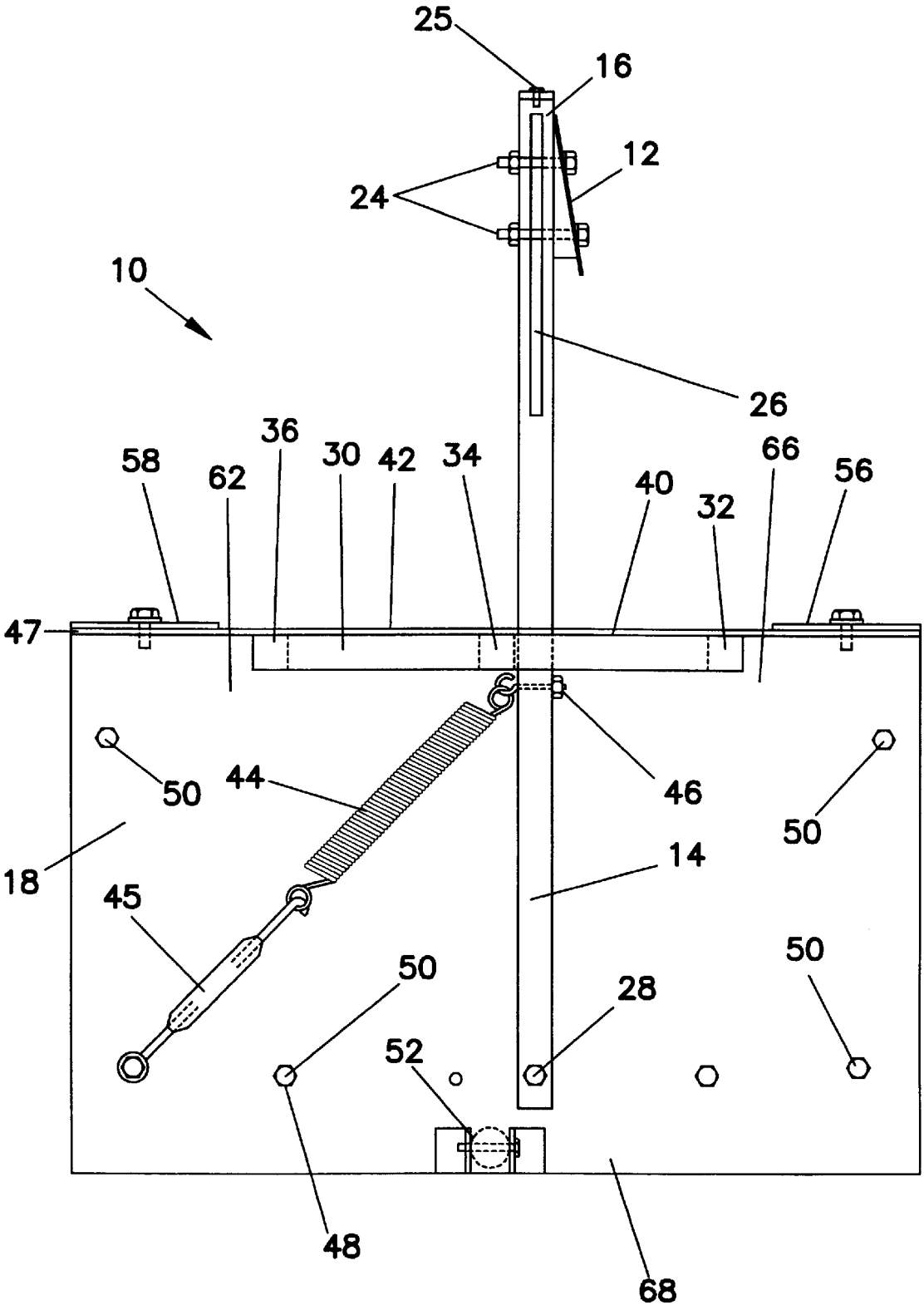
FIG. 1 shows an elevated top view of the device for cutting filler material from concrete joints.
Figure 2:
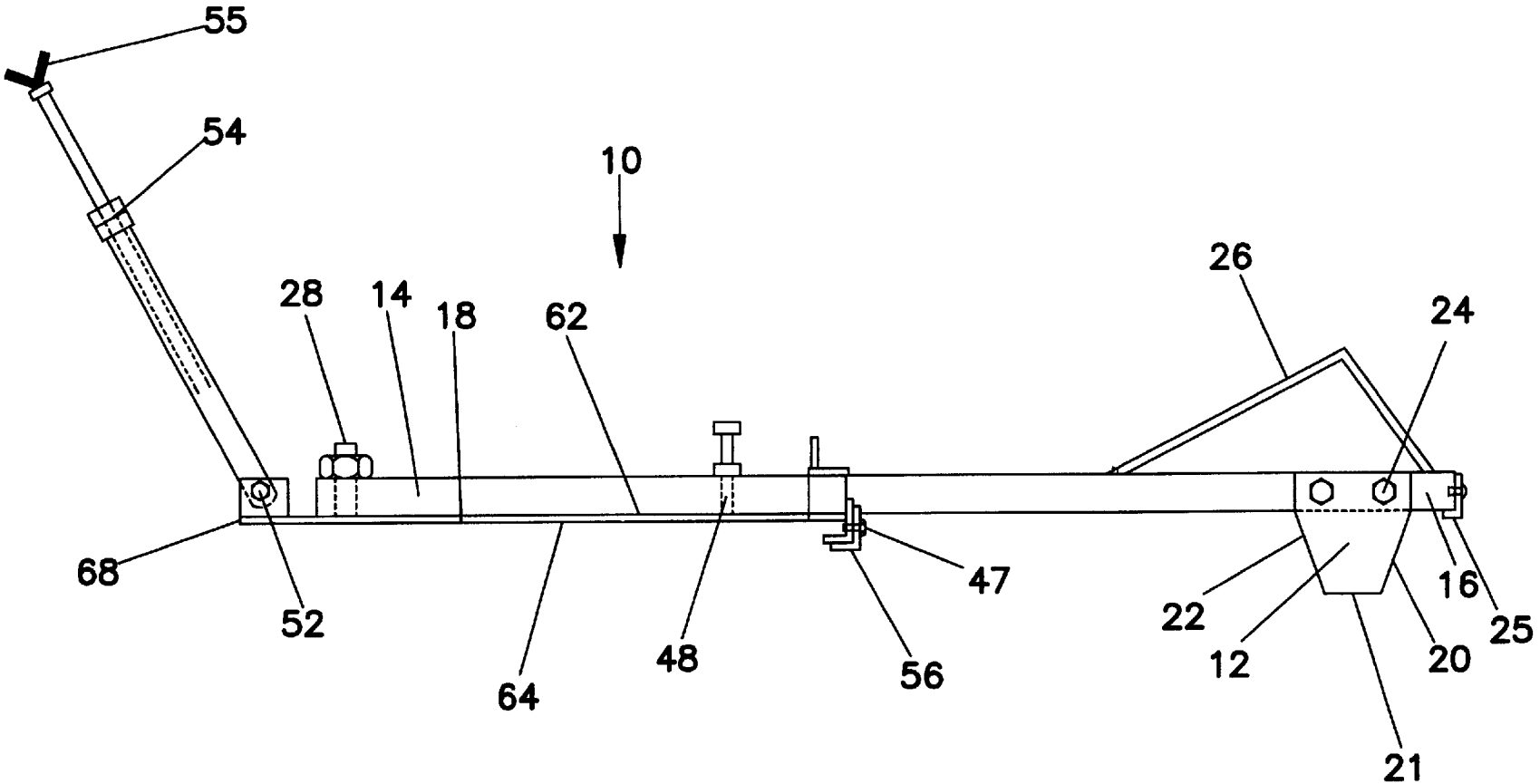
FIG. 2 shows a side view of the device for cutting filler material from concrete joints.
Figure 3:
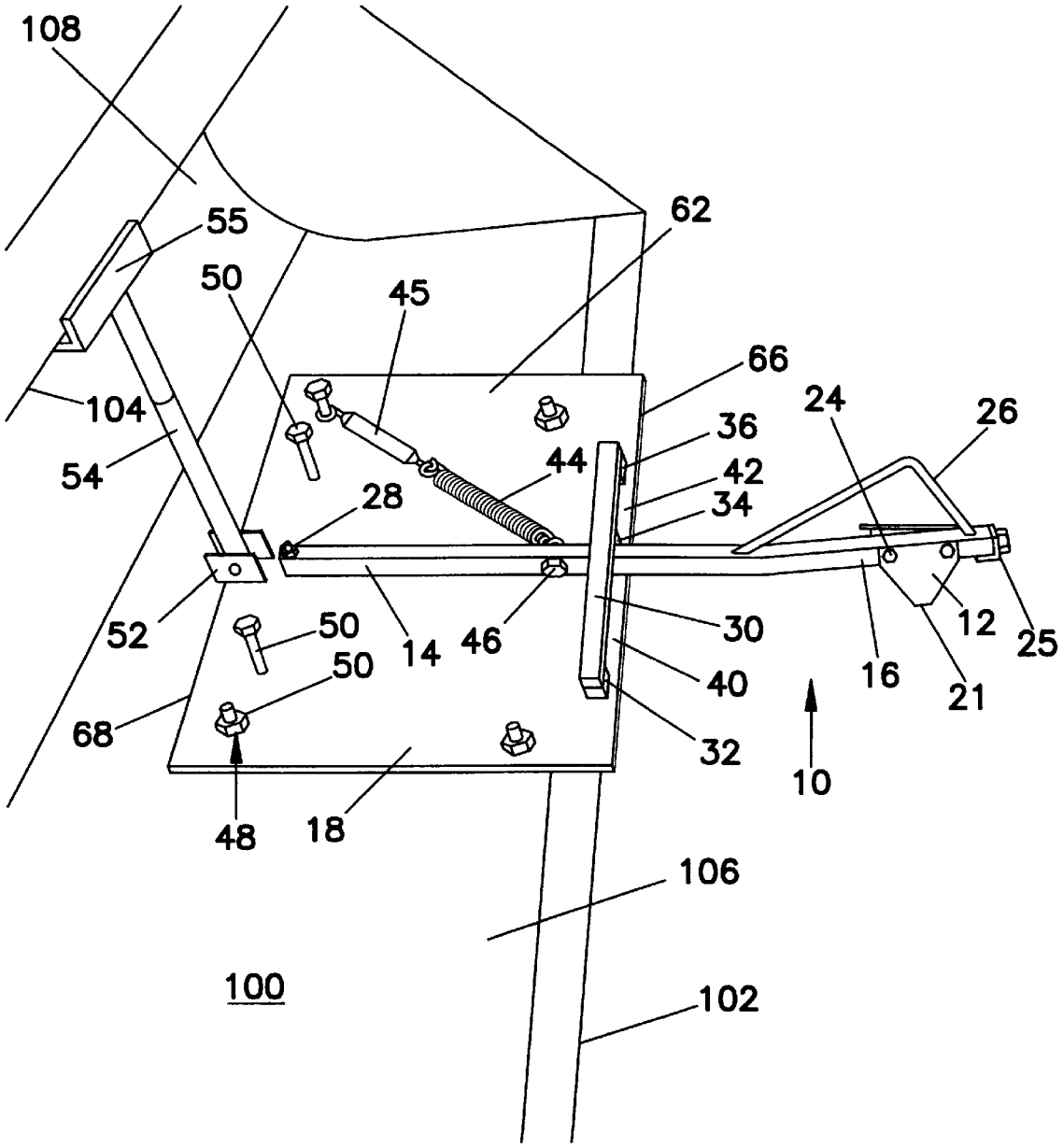
FIG. 3 shows a side perspective view of the device mounted in a bucket.
Figure 4:
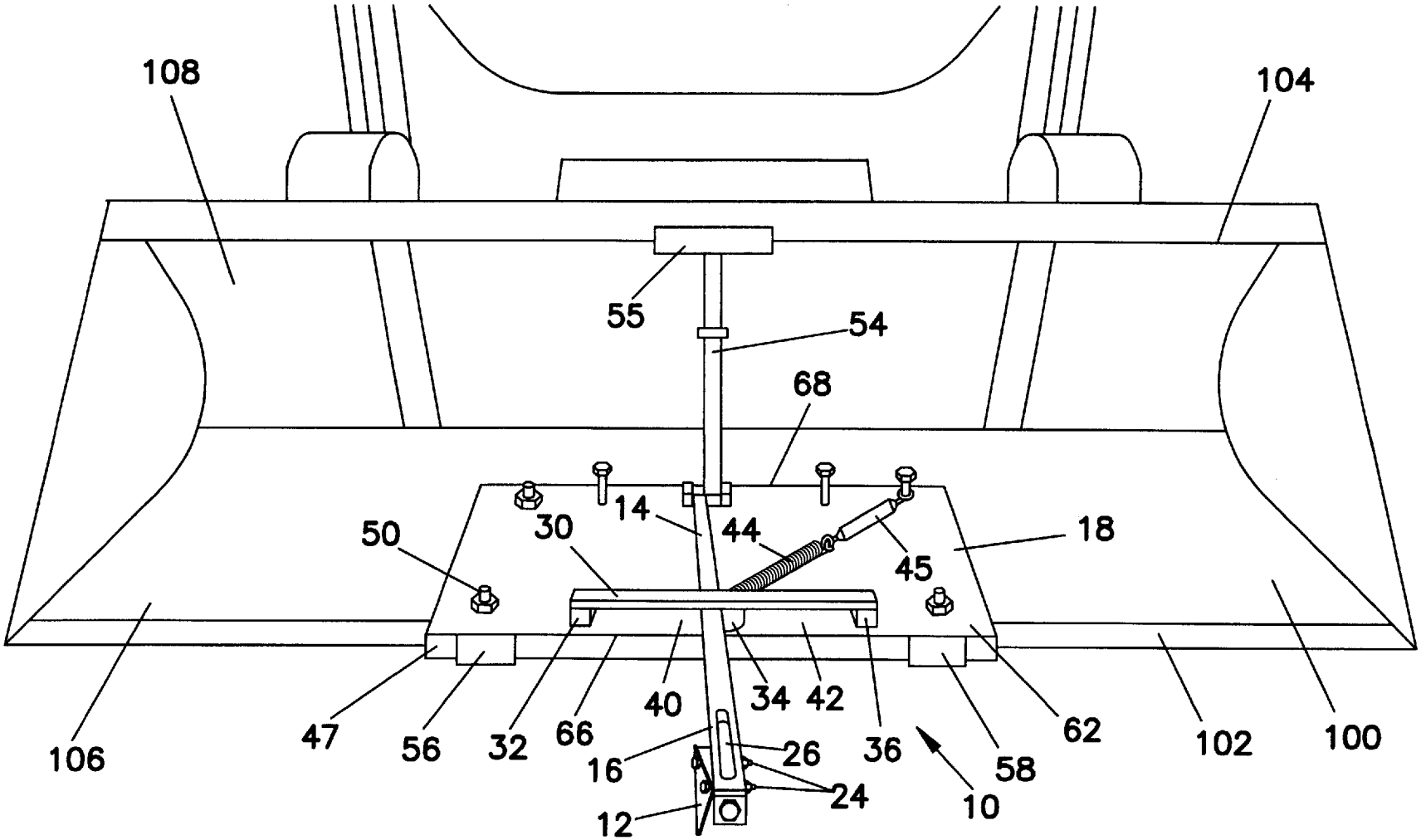
FIG. 4 shows a front perspective view of the device mounted in the bucket.
Figure 5:
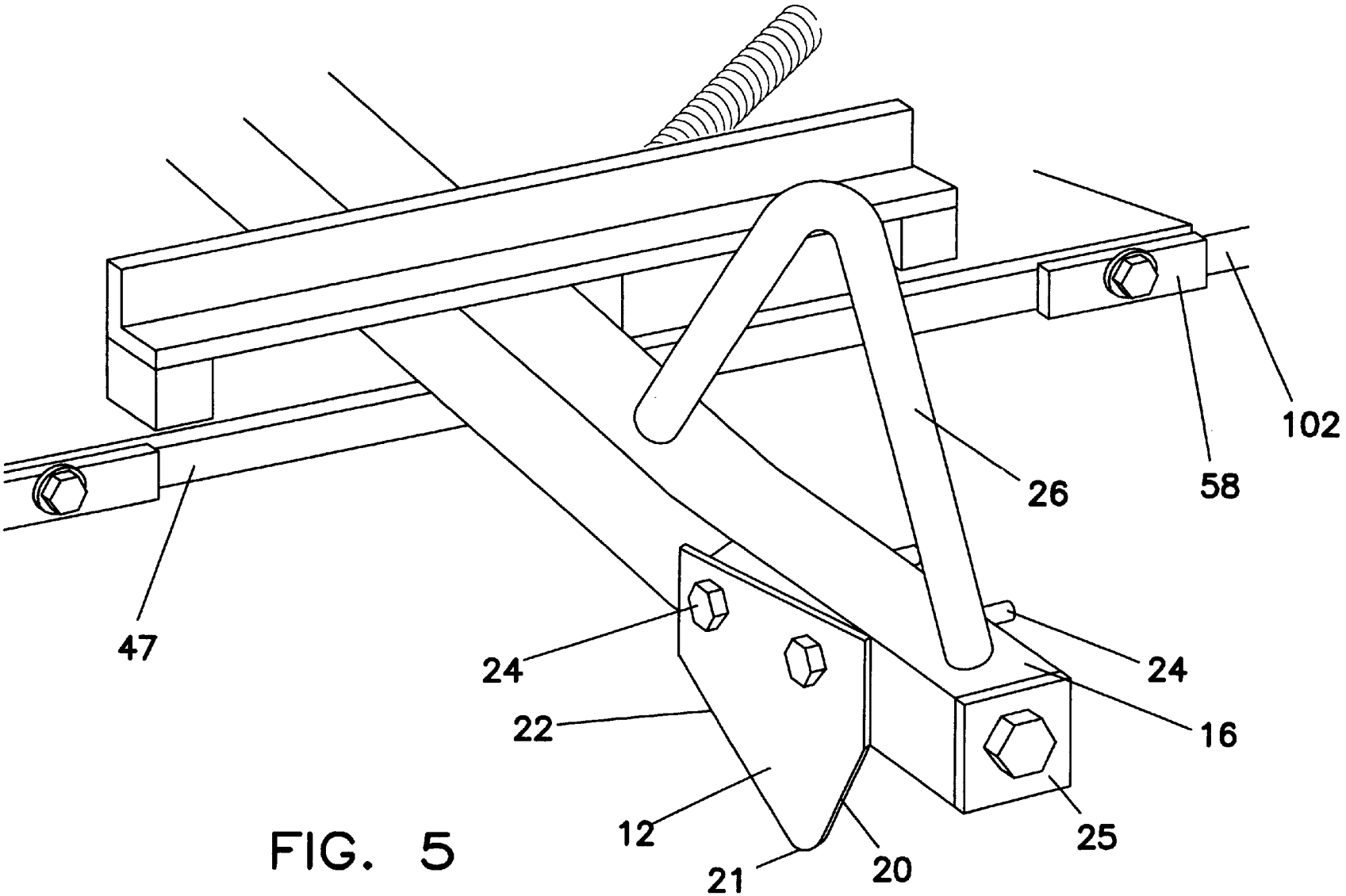
FIG. 5 shows a side perspective view of the free end of the elongated arm.

Referring to FIGS. 1–5, a device for cutting filler material from expansion joints 10 comprises a joint cutting blade 12 mounted at the free end 16 of an extended horizontally swinging extending arm 14 which is pivotally attached to a rugged steel mounting plate 18 by a bolt 28, and the mounting plate in turn is mounted on the bucket 100 of a front end loader or the like to position the blade 12 forwardly of the bucket 100. The bucket 100 typically comprises a front edge 102, a back edge 104, a bottom 106 and a top 108.

The joint cutting blade 12 which is attached to the horizontally swinging arm 14 is triangular in shape and includes two cutting edges 20 and 22 which intersect at the apex 21 of the triangular shaped cutting blade 12. The joint cutting blade 12 is removably fixed to the horizontally swinging arm 14 with nuts and bolts 24 or other removable attachment means so that the blade 12 may be removed and replaced, or the blade 12 may simply be turned around so that cutting is performed along a different cutting edge. Furthermore, the dual edge blade 12 provides for cutting action along an expansion joint with the machine carrying the blade 12 moving either forward or in reverse. The blade 12 is positioned so that the apex 21 of the cutting edges is located downward from the horizontally swinging arm 14. The horizontally swinging arm 14 may be slightly bent at the free end 16 to position the blade 12 in a position substantially parallel to the surface to be cut. Typically, the arm 14 is bent between two (2) and eight (8) degrees, depending upon the machine being used with the device 10, and particularly, the size of bucket and line of sight of the operator.

Also fixed to the free end 16 of the horizontally swinging arm 14 is a front handle 26. The front handle 26 is also used as a sight guide 26 for the operator of the machine. The front handle 26 is an L-shaped cylindrical piece of steel having two ends, the two ends welded to the top of the horizontally swinging arm 14. Additionally, an arm skid plate 25 is attached to the free end 16 of the horizontally swinging arm 14. The arm skid plate 25 protects the horizontally swinging arm 14 by preventing the arm from coming into direct contact with the pavement during operation of the device 10.

While one end of the horizontally swinging arm 14 holds the blade 12 and front handle 26, an opposite end of the arm 14 is pivotally attached near the rear of the mounting plate 18. The arm 14 may be attached by a single bolt and nut 28 or any other method to secure the arm 14 to the mounting plate 18 while allowing for pivotal movement of the horizontally swinging arm 14.

A retention bar 30 is situated near the front of the mounting plate 18 to provide support and guidance for the arm 14. The retention bar 30 fixedly rests on three steel connectors 32, 34, 36. A first connector 32 is positioned at one end of the retention bar 30, a second connector 34 is positioned near the center of the retention bar 30, and a third connector 36 is positioned near an opposite end of the retention bar 30. First and second elongated channels 40 and 42 are formed by the mounting plate 18, the connectors 32, 34 and 36, and the retention bar 30. The horizontally swinging arm 14 is threaded through the first elongated channel 40, and the first elongated channel serves as a guide for the horizontally swinging arm 14. Additionally, movement of the horizontally swinging arm 14 is limited by the first elongated channel 40.

A spring 44 is positioned between the extended arm 14 and an edge of the mounting plate 18. One end of the spring is connected by means of a connection pin 46 to the extended arm 14 near the retention bar 30 to bias the extended arm 14 toward the center of the mounting plate 18. A second end of the is attached to a spring turnbuckle 45, and the spring turnbuckle 45 is pivotally fixed to the mounting plate 18. Adjustment of the spring turnbuckle 45 may be made by shortening or extending the turnbuckle, and thus influence tension upon the spring. Furthermore, the design of the mounting plate 18 may be easily reversed such that the extended arm 14 is threaded through the second elongated channel 42.

The mounting plate 18 comprises a rectangular piece of steel having a top 62, a bottom 64, a forward edge 66 and a rear edge 68. An attachment lip 47 is provided integral with the forward edge 66 of the mounting plate. The attachment lip hooks down and under the bottom 64 of the mounting plate, and is designed for receiving the front edge 102 of the bucket 100 during mounting of the device. Two skid plates 56 and 58 are removably affixed by means of a nut and bolt to the forward edge 66 of the mounting plate 18 such that the skid plates 56 and 58 wrap around and under the attachment lip 47. The skid plates 56 and 58 protect the attachment lip 47 from damage during operation of the device by distancing the attachment lip 47 from concrete slabs.

Threaded bores 48 extend through the mounting plate 18 at various locations on the mounting plate 18. Mounting bolts 50 are threaded through the bores 48 on the mounting plate 18 and engage the bucket bottom 106 to assist in securing the mounting plate 18 to the bucket. Furthermore, a hinge 52 is fixedly secured near the rear edge 68 of the mounting plate 18 for cooperation with a mounting turnbuckle 54 to further assist in securing the mounting plate 18 to the bucket. The mounting turnbuckle 54 engages the hinge 52 at one end, and includes a V-shaped plate 55 at the opposite end. The V-plate 55 is designed to engage the back edge 102 the bucket 100 when the device is mounted in the bucket.

The invention is mounted to a front end loader or similar device having a front loading bucket 100. Mounting is accomplished by placing the mounting plate 18 in the bucket and hooking the attachment lip 47 around the front edge of the bucket such that the attachment lip 47 touches the underside of the bottom 106 of the bucket. Tightening the mounting bolts 50 places an upward force on the mounting plate 18, while the attachment lip 47 retains the mounting plate against the bucket 100. These forces assist in securing the mounting plate to the bucket. Additionally, the V-plate 55 is engaged with the back edge 104 of the bucket 100 and the mounting turnbuckle 54 is elongated. Elongation of the mounting turnbuckle 54 wedges the device in the bucket by application of pressure to the back edge and bottom of the bucket.

In operation, the device for cutting filler material from concrete joints is mounted to the bucket with the extended arm 14 projecting forwardly from the front edge of the lower front of the bucket. The blade 12 is placed into the side of a joint where filler material is to be removed. The front handle 26 may be used by the operator as a sight guide. Forward movement of the machine holding the bucket causes the blade 12 to carve along one side of the expansion joint, loosening filler material from the joint. The blade 12 is allowed to deviate from right to left and vice-versa by the extended arm 14 in a float or follow fashion along the edge of the concrete. The total amount of horizontal and vertical play in the arm 14 is restricted by the first channel. Blade deviation usually occurs when the blade 12 encounters stiff resistance beyond that offered by the filler material. Nevertheless, even when the blade 12 deviates from the center of the mounting plate 18, the spring biases the arm 14 and blade 12 back to a center position. Repeating this process along the opposite side of the joint sufficiently loosens or removes the filler material such that the filler material may be easily pulled from the joint. As mentioned above, the device for cutting filler material from concrete joints may also be operated with the tractor moving in reverse because the blade 12 is dual edged.

What is claimed is:

1. A device capable of being attached to a motorized vehicle for removing filler material from concrete joints comprising:

(a) a mounting plate having a top, a bottom, a forward edge, and a rear edge, said mounting plate being adapted to be attached to the motorized vehicle;

(b) an elongated arm having a pivoting end pivotably attached to said top of said mounting plate and a free end positioned beyond said forward edge of said mounting plate;

(c) a blade secured to said free end of said elongated arm and extending downwardly from said arm;

(d) a spring having two ends, one end of said spring attached to said mounting plate and the opposite end of said spring attached to said elongated arm, said spring biasing said elongated arm toward a predetermined position; and (e) a retention bar positioned over said elongated arm and attached to said mounting plate in such a manner as to allow movement of said elongated arm in a horizontal direction along a predetermined path of travel.

2. The device of claim 1 further comprising a central connector attaching said retention bar to said mounting plate, said spring providing a biasing force which biases said elongated arm towards said central connector.

3. The device of claim 2 further comprising an end connector located between said mounting plate and said retention bar such that a channel is defined by said retention bar, said central connector, said mounting plate and said end connector, said elongated arm extending through said channel and movement of said elongated arm restricted by said channel.

4. The device of claim 2 further comprising a coupler for connecting said spring to said mounting plate, said coupler capable of being adjusted in length to increase or decrease said biasing force of said spring.

5. The device of claim 1 wherein said blade is triangular shaped with two cutting edges along opposite sides of said triangular blade.

6. The device of claim 1 wherein said elongated arm is bent at a point beyond said forward edge of said mounting plate so that said elongated arm and blade will properly align with the concrete joints.

7. The device of claim 1 further comprising an attachment lip extending along said forward edge of said mounting plate, said attachment lip hooking down and under said mounting plate and adjusted to engage a mating portion of the motorized vehicle.

8. The device of claim 7 wherein at least one skid plate is fixed to said mounting plate such that said at least one skid plate extends under said attachment lip.

9. The device of claim 1 wherein said mounting plate further comprises threaded holes extending through said mounting plate, the threaded holes for receiving bolts to assist in mounting the device to the motorized vehicle.

10. The device of claim 1 wherein said elongated arm is pivotably attached to said mounting plate toward said rear edge of said mounting plate by a bolt and a nut.

11. The device of claim 1 further comprising an L-shaped handle having two ends, said L-shaped handle fixedly secured to said free end of said elongated arm such that said two ends of said L-shaped handle are integral with said elongated arm.

12. The device of claim 1 further comprising an expandable turnbuckle having two ends, one end of said turnbuckle connected to said mounting plate, and the opposite end of said turnbuckle adapted to engage a portion of the motor vehicle so that said plate may be secured to said vehicle when said turnbuckle is expanded.

13. A method of removing filler material from an expansion joint comprising the steps of:

a) providing a power vehicle having a bucket that can be raised or lowered, said bucket including a front edge and a back edge;

b) attaching a device to said bucket, said device comprising a mounting plate, an elongated arm pivotably attached to said mounting plate at a first end of said elongated arm, a second end of said elongated arm extending beyond a forward edge of said mounting plate and said front edge of said bucket, a blade fixedly secured to said second end of said elongated arm and extending downwardly therefrom, and a spring attached between the ends of said elongated arm and biasing said elongated arm toward a central portion of the mounting plate;

c) inserting the blade into the expansion joint by lowering the bucket;

d) moving the power vehicle such that the blade moves through the expansion joint thereby cutting the filler material within the expansion joint; and e) pulling the cut filler material from the expansion joint.

14. The method of claim 13 wherein an expandable turnbuckle is attached to said mounting plate and extends to and engages said back edge of said bucket to assist in securing said mounting plate in said bucket.

15. The method of claim 13 wherein said mounting plate includes an attachment lip adapted to hook around and under said bucket front edge to assist in securing said mounting plate in said bucket.

16. A device capable of being attached to a bucket of a power vehicle to remove filler material from expansion joints, the bucket having a front edge and a back edge and capable of being raised and lowered, and the device comprising:

(a) a mounting plate having a forward edge, a rear edge and a central location, the mounting plate adapted to be mounted to the bucket of the power vehicle;

(b) an arm having a free end and a pivot end, said free end positioned beyond said forward edge of said mounting plate and said pivot end pivotably attached to said mounting plate so that said arm can pivot horizontally but not vertically along a predetermined path, said arm extending beyond the front edge of the bucket when said mounting plate is mounted in the bucket;

(c) cutting means secured to said free end of said arm, said cutting means for engaging the filler material and cutting the filler material from the expansion joints when the bucket is lowered and said cutting means is inserted into the expansion joint; and (d) means for attaching said mounting plate to the bucket.

17. The device of claim 16 further comprising a retention means surrounding said arm and fixed to said mounting plate, said retention means for limiting the horizontal and vertical movement of said arm and defining said predetermined path of travel of said arm.

18. The device of claim 16 further comprising a means for biasing said arm towards said central location on said mounting plate such that a biasing force acts upon said arm to encourage the arm toward to the central location when said arm deviates from said central location.

19. The device of claim 18 further comprising a coupling means attached to said means for biasing, said coupling means capable increasing or decreasing said biasing force acting upon said arm.

* * * * *